US010297376B2

(12) United States Patent
Church

(10) Patent No.: US 10,297,376 B2
(45) Date of Patent: May 21, 2019

(54) BI-STABLE PIN ACTUATOR

(71) Applicant: The United States of America as represented by the Administrator of NASA, Washington, DC (US)

(72) Inventor: Joseph C. Church, Washington, DC (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 22 days.

(21) Appl. No.: 15/714,119

(22) Filed: Sep. 25, 2017

(65) Prior Publication Data

US 2019/0096557 A1 Mar. 28, 2019

(51) Int. Cl.
*H01F 7/00* (2006.01)
*H01F 7/16* (2006.01)

(52) U.S. Cl.
CPC ..... *H01F 7/1615* (2013.01)

(58) Field of Classification Search
CPC ..... H01F 7/1615; H01F 2007/1669
(Continued)

(56) References Cited

U.S. PATENT DOCUMENTS 3,022,450 A * 2/1962 Chase, Jr. ..... H01F 7/1615 29/527.6
3,381,181 A * 4/1968 Weathers ..... H01F 7/1615 335/230

(Continued)

*Primary Examiner* — Alexander Talpalatski
(74) *Attorney, Agent, or Firm* — Matthew F. Johnston; Bryan A. Guerts; Mark P. Dvorscak

(57) ABSTRACT

A bi-stable pin actuator includes a soft magnetic core and having a first central portion and a second central portion spaced apart from the first central portion. The first central portion has a first passage extending there-through and the second portion has a second passage extending there-through which is coaxial with the first passage. A first coil is wound about the first central portion and a second coil is wound about the second central portion. A pair of permanent magnets are located in the space between the first central portion and second central portion and attached to the core. An armature is movably positioned between and spaced apart from the permanent magnets. A pin is attached to the armature and extends into the first passage and second passages such that movement of the armature results in movement of the pin within the first passage and second passage. The armature moves between a first position wherein the armature is adjacent to the first central portion of the core and a second position wherein the armature is adjacent to the second central portion of the core. The armature is in one stable state when in the first position and in another of the stable state when in the second position. The magnets generate magnetic flux having a magnetic flux density sufficient to hold the armature in either of the stable states when neither of the coils is energized. When the armature is in the first stable state, only a first end of the pin protrudes from the core. When the armature is in the second stable state, only an opposite second end of the pin protrudes from the core. Energizing at least one of the coils generates a magnetic flux in one section of the actuator that opposes the magnetic flux holding the armature in a current stable state and supplements the magnetic flux in another section of the actuator so as to shift the armature into another stable state.

14 Claims, 5 Drawing Sheets

(58) Field of Classification Search
USPC ..... 335/234
See application file for complete search history.

(56) References Cited

U.S. PATENT DOCUMENTS 3,772,540 A * 11/1973 Benson ..... H01F 7/145
310/14
4,751,487 A * 6/1988 Green, Jr. ..... H01F 7/1615
335/230
5,365,210 A * 11/1994 Hines ..... H01F 7/1615
335/173
5,389,910 A * 2/1995 Abel ..... H01F 7/1615
335/237
5,452,172 A * 9/1995 Lane ..... H01F 7/1615
361/71
6,265,956 B1 * 7/2001 Cascolan ..... H01F 7/1615
335/234
2002/0153982 A1 * 10/2002 Jones ..... H01F 7/122
335/220
2010/0176902 A1 * 7/2010 Volkmar ..... H01F 7/081
335/84
2013/0328649 A1 * 12/2013 Robertson ..... H01F 7/08
335/234

* cited by examiner

BI-STABLE PIN ACTUATOR

ORIGIN OF INVENTION

The invention described herein was made by an employee of the United States Government, and may be manufactured and used by or for the Government for governmental purposes without the payment of any royalties thereon or therefor.

CROSS REFERENCE TO OTHER PATENT APPLICATIONS

None.

FIELD OF THE INVENTION

The present invention relates to a bi-stable pin actuator.

BACKGROUND

Actuator devices are used in all types of industries, e.g. space, aerospace, automotive, etc. There are many types and sizes of actuator devices. The size of the actuator device is a critical issue especially in applications where there is limited space. One commonly used actuator device is a solenoid. Solenoids are used in many industries. However, small-sized solenoids typically cannot produce the required forces and also require electrical power to hold the solenoid in one state or the other. Other common actuator devices are Frangibolts and other Shaped Memory Alloy (SMA) devices. However, both of these devices rely on heating a fairly large piece of SMA. As a result, these two devices have relatively slow actuation times and require significant energy to actuate and generate significant heat. Burn-wires and pyrotechnic bolts are two other types of actuator devices. However, these devices produce contaminants upon activation. What is needed is a new and improved actuator device that does not have the aforementioned disadvantages of conventional actuator devices.

SUMMARY OF THE INVENTION

The present invention is directed to a bi-stable pin actuator. The bi-stable pin actuator is an electromagnetic device that actuates an output pin between a first position and a second position. The bi-stable pin actuator includes a core made of a soft magnetic material. In an exemplary embodiment, the core includes a first portion and a second portion that is attached to the first portion wherein the first portion and second portion are mirror images of each other. The bi-stable pin actuator includes an armature that is movable within the core and between the first position and the second position. The armature is made from soft magnetic material. The bi-stable pin actuator further includes a pair of permanent magnets attached to the core. The permanent magnets do not move and are oriented such that like poles of the magnets face each other. The armature is located between and spaced apart from the permanent magnets. An output pin is attached to the armature and thus moves with the armature. The first portion of the core includes a first winding and a second portion of the core includes a second winding. The core, permanent magnets and armature cooperate to create a bi-stable magnetic structure. The armature is naturally forced to either the first position or the second position due to the nature of the magnetic fields created by the bi-stable magnetic structure. When the armature is in the first position, it is in one stable state and when the armature is in the second position, it is in another stable state. When the armature is in one stable state, the output pin protrudes from one end of the bi-state pin actuator. When the armature is in another stable state, the output pin protrudes from an opposite end of the bi-state pin actuator. When the armature is in one of the two stable states, substantially all of the magnetic flux is constrained to the section of the bi-stable magnetic structure where the armature is positioned. The magnetic flux in the other section of the bi-stable magnetic structure does not have the strength to pull the armature over to the stable state. In order to shift the armature to the second position, and thus the other stable state, an electrical current is applied to one or both windings in order to oppose the magnetic flux holding the armature in the current stable state and supplementing the magnetic flux in the other section of the bi-stable magnetic structure in order to "steer" flux to that other section of the bi-stable magnetic structure. As a result, the armature is pulled into the second position and thus, the other stable state. If a sufficient electrical current is used, only one winding need be energized in order to shift the armature to the other stable state. Optionally, both windings may be energized to produce flux that increases the holding force on the armature in order to hold the armature in its current stable state until it is desired to shift the armature to the other stable state.

In an exemplary embodiment, the bi-stable pin actuator of the present invention includes a core made from soft magnetic material. The core includes a first central portion and a second central portion that is separated from the first central portion by a space. The first central portion has a first passage extending there-through and the second portion has a second passage extending there-through. The second passage is coaxial with the first passage. A first conductive coil is wound about the first central portion of the core. A second conductive coil is wound about the second central portion of the core. A first permanent magnet is located within the space between the first central portion and second central portion and attached to the core. A second permanent magnet is located within the space between the first central portion and second central portion and is attached to the core. The second permanent magnet is located across from the first permanent magnet. The first permanent magnet and the second permanent magnet have horizontally aligned North (N) and South (S) poles. The first permanent magnet and the second permanent magnet are aligned such that like poles face each other. A soft magnetic armature is movably positioned within the space between the first central portion and the second central portion. The armature is positioned between and spaced apart from the first permanent magnet and the second permanent magnet. The armature has a third passage that is coaxial with the first passage and the second passage and is movable between a first position wherein the armature is adjacent to the first central portion of the core and a second position wherein the armature is adjacent to the second central portion of the core. The armature is in one stable state when in the first position and in another stable state when in the second position. The first permanent magnet and the second permanent magnet generate magnetic flux having a magnetic flux density sufficient to hold the armature in either stable state when neither conductive coil is energized. The bi-stable pin actuator includes a pin that has a first end and an opposite second end. The pin extends through the third passage of the armature and is attached to the armature. The pin extends into the first passage of the first central portion of the core and into the second passage of the second central portion of the core such that movement of the armature causes the pin to longitudinally move within the first passage and the second passage. When the armature in in one stable state, only the first end of the pin protrudes from the core. When the armature is in another stable state, only the opposite second end of the pin protrudes from the core. Energizing at least one of the conductive coils generates in a first section of the bi-stable pin actuator a magnetic flux that opposes the magnetic flux holding the armature in the current stable state and supplements the magnetic flux in a second section of the bi-stable pin actuator so as to magnetically pull the armature into the other stable state.

Other aspects and advantages of the invention will become apparent from the following detailed description taken in conjunction with the accompanying drawings which illustrate, by way of example, the principles of the described embodiments.

DESCRIPTION OF EXEMPLARY EMBODIMENTS

Figure 1:
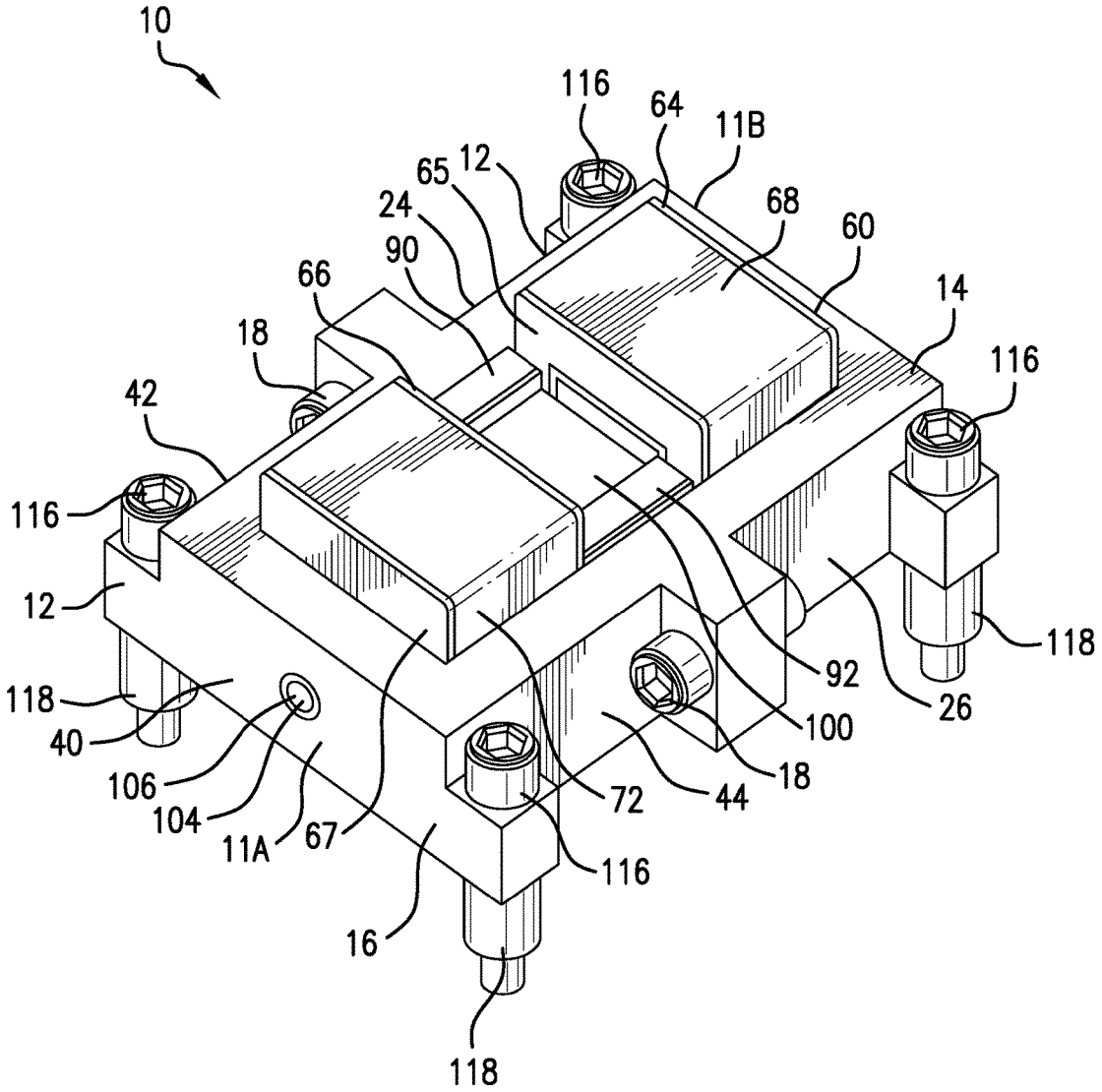
FIG. 1 is a perspective view of a bi-stable pin actuator in accordance with an exemplary embodiment of the present invention.

Referring to FIGS. 1-5, there is shown bi-stable pin actuator 10 in accordance with an exemplary embodiment. Actuator 10 has a first section 11A, second section 11B and core 12. In a preferred embodiment, core 12 is made from a soft magnetic material. Examples of suitable soft magnetic materials include iron, silicon steel and Vanadium Permendur. Core 12 includes first section 14 and second section 16. First section 14 and second section 16 are mirror images of each other and are identical in construction and structure. First section 14 and second section 16 are attached together by bolts 18 and nuts 20 which are further described in the ensuing description. First section 14 has widthwise end portion 22 and leg portion 24 which extends from widthwise end portion 22. In an exemplary embodiment, leg portion 24 is generally "L" shaped. Leg portion 24 includes outwardly extending lip 24A which has thru-hole 25 for receiving bolt 18. First section 14 further includes leg portion 26 which extends from widthwise end portion 22. In an exemplary embodiment, leg portion 26 is generally "L" shaped. Leg portion 26 includes outwardly extending lip portion 26A which has thru-hole 27 for receiving bolt 18. First section 14 includes central portion 28 which extends from widthwise end portion 22. Space 30 separates central portion 28 and leg portion 24. Space 32 separates central portion 28 and leg portion 26. Central portion 28 includes end 36. First section 14 further includes internal passage 38 that extends through widthwise end portion 22 and central portion 28. Internal passage 38 has opening 39 in widthwise end portion 22 and another opening (not shown) in end 36 of central portion 28. Second section 16 has widthwise end portion 40 and leg portion 42 which extends from widthwise end portion 40. In an exemplary embodiment, leg portion 42 is generally "L" shaped. Leg portion 42 includes outwardly extending lip portion 42A which has thru-hole 43 for receiving bolt 18. Thru-hole 43 is coaxial with thru-hole 25 of lip portion 24A. Second section 16 further includes leg portion 44 which extends from widthwise end portion 40. In an exemplary embodiment, leg portion 44 is generally "L" shaped. Leg portion 44 includes outwardly extending lip portion 44A which has thru-hole 45. Thru-hole 45 is coaxial with thru-hole 27 of lip portion 26A. Second section 16 includes central portion 46 which extends from widthwise end portion 40. Space 50 separates central portion 46 and leg portion 42. Space 52 separates central portion 46 and leg portion 44. Second section 16 further includes internal passage 56 that extends through widthwise end portion 40 and central portion 46. Internal passage 56 has opening 58 in widthwise end portion 40 and another opening (not shown) in end 54 of central portion 46. Internal passage 56 is coaxial with internal passage 38 in central portion 28.

Referring to FIGS. 1-4A, 4B and 5, actuator 10 includes a pair of spools 60 and 61. Spools 60 and 61 are identical in construction. Spool 60 has central opening 62 that is sized to receive central portion 28 of core 12. Spool 60 includes ends 64 and 65. Spool 61 also has a central opening (not shown) that is sized to receive central portion 46 of core 12. Spool 61 includes ends 66 and 67. In an exemplary embodiment, spools 60 and 61 are made from fiberglass. In one embodiment, the fiberglass is G10 fiberglass. It is to be understood that spools 60 and 61 may be fabricated from other materials having properties similar to G10 fiberglass. Actuator 10 includes electrically conductive coil or winding 68 that is wound about spool 60. Winding 68 includes ends (not shown) that are connected to an electrical current source. In an exemplary embodiment, winding 68 is made from copper. In an exemplary embodiment, the electrical current source is a battery. However, it is to be understood that other suitable electrical current sources may be used. A flux is generated when an electrical current flows through winding 68. Actuator 10 includes electrically conductive coil or winding 72 that is wound about spool 61. Winding 72 includes ends (not shown) for connection to the electrical current source. In an exemplary embodiment, winding 72 is made from copper. A flux is generated when an electrical current flows through winding 72. Applying an electrical current to windings 68 and 72 energizes the windings thereby generating a magnetic flux.

It is to be understood that in some embodiments, actuator 10 is configured without spools 60 and 61. In such an embodiment, windings 68 and 72 are wound directly on central portions 28 and 46, respectively.

Figure 2:
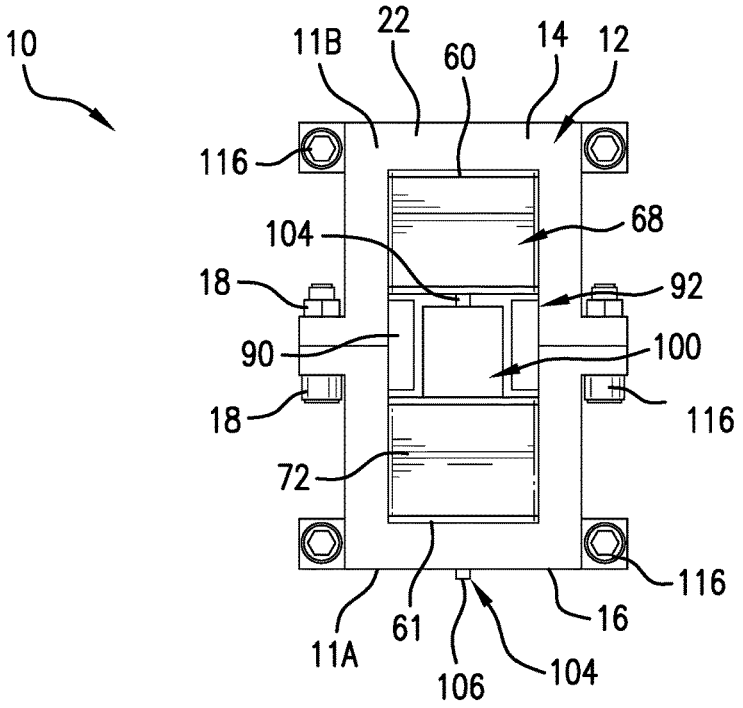
FIG. 2 is a plan view of the bi-stable pin actuator.
Figure 3:
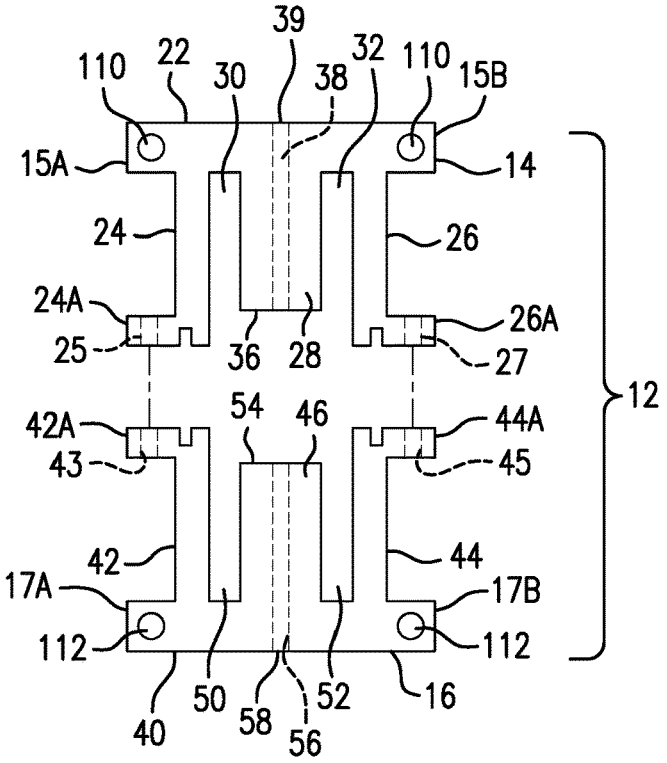
FIG. 3 is an exploded view of a soft magnetic core shown in FIGS. 1 and 2.
Figure 4A:
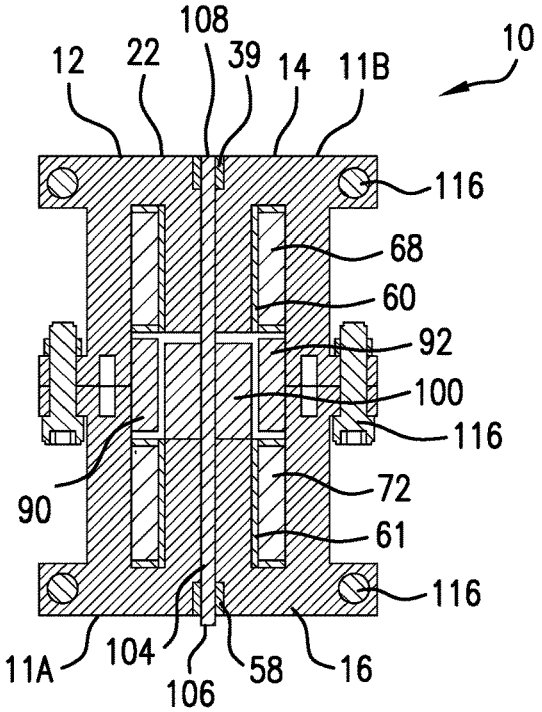
FIG. 4A is a cross-sectional view of the bi-stable pin actuator.
Figure 4B:
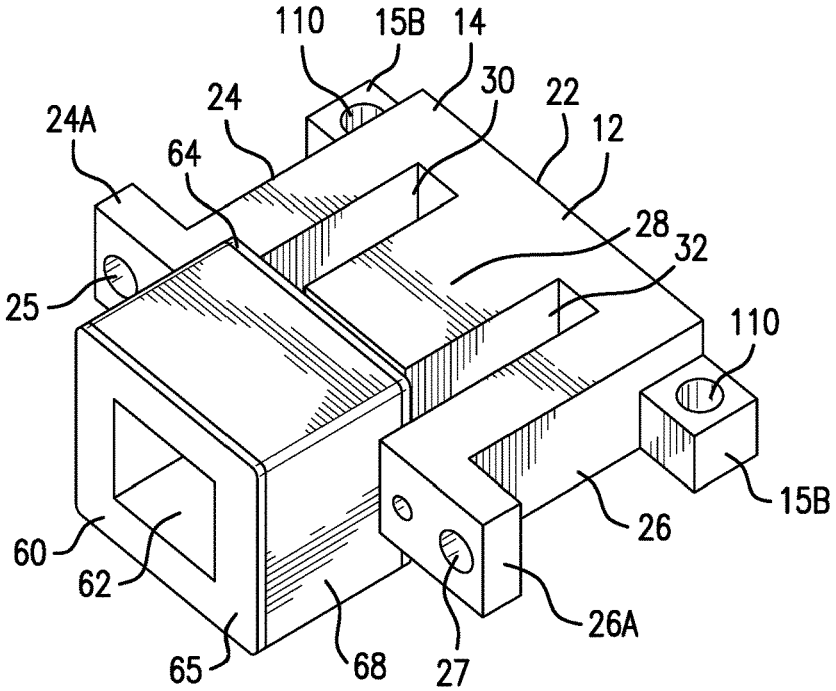
FIG. 4B is a perspective view of a portion of the soft magnetic core and a winding spool that is configured to be mounted on a portion of the soft magnetic core.

In an exemplary embodiment, bolts 18 and nuts 20 are made from stainless steel. However, it is to be understood that bolts 18 and nuts 20 may be made from other metals as well. Referring to FIGS. 2 and 4A, when first section 14 and second section 16 are attached together with bolts 18 and nuts 20, central portion 28 and central portion 46 are spaced apart by a space 80. Actuator 10 further includes permanent magnet 90 and permanent magnet 92 that are located in space 80 and are attached to core 12. Permanent magnet 90 is attached to a portion of first section 14 of core 12 and to a portion of second section 16 of core 12. In an exemplary embodiment, permanent magnet 90 is bonded to the portions of first section 14 and second section 16. However, other suitable techniques may be used to attach permanent magnet 90 to the portions of first section 14 and second section 16. Similarly, permanent magnet 92 is attached to a portion of first section 14 and to a portion of second section 16. In an exemplary embodiment, permanent magnet 92 is bonded to the portions of first section 14 and second section 16. However, other suitable techniques may be used to attach permanent magnet 92 to the portions of first section 14 and second section 16. Permanent magnet 90 and permanent magnet 92 each have horizontally aligned North (N) and South (S) poles. Permanent magnet 90 and permanent magnet 92 are aligned and oriented such that like poles face each other. In an exemplary embodiment, permanent magnets 90 and 92 are made from Neodymium-Iron-Boron (rare earth) or Samarium Cobalt. However, permanent magnets 90 and 92 may be made from other suitable materials.

Referring to FIGS. 1, 2 and 4A, bi-stable pin actuator 10 further includes armature 100 that is located within space 80. Armature 100 is positioned between and spaced apart from permanent magnets 90 and 92. Armature 100 is made from soft magnetic material. Suitable soft magnetic materials include iron, silicon steel and Vanadium Permendur. In an exemplary embodiment, armature 100 includes internal passage 102 therein. Bi-stable pin actuator 10 further includes pin or central rod 104 that is positioned in internal passage 102 and attached or joined to armature 100 such that pin 104 moves along with armature 100. Pin 104 also extends through internal passage 38 of first section 14 and through internal passage 56 of second section 16. Pin 104 can freely move longitudinally within internal passages 38 and 56. In an exemplary embodiment, pin 104 is made from stainless steel because it is non-magnetic and has the requisite strength. However, pin 104 made be made from other suitable materials as well.

Figure 5:
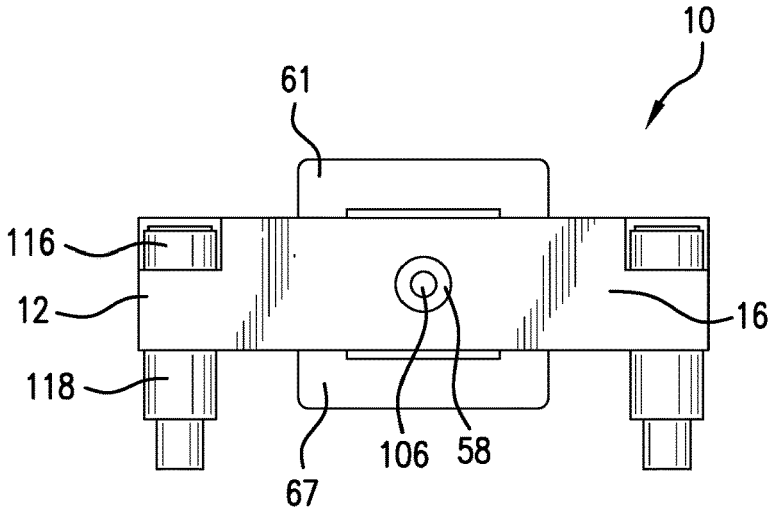
FIG. 5 is an end view of the bi-stable pin actuator.

Referring to FIGS. 1, 2 and 5, first section 14 includes through-holes 110 and second section 16 includes through-holes 112. Through-holes 110 and 112 are sized to receive bolts or screws 116. Nuts 118 are fastened to bolts 116. Each bolt 116 has a predetermined length that allows actuator 10 to be attached to any surface, structure or apparatus so that windings 60 and 72 are spaced apart from such surface, structure or apparatus. In an exemplary embodiment, bolts 116 and nuts 118 are made from stainless steel.

Armature 100 moves between a first position and a second position. When armature 100 is in either of these positions, armature 100 is in a stable state. For example, when armature 100 is in the first position, it is in one stable state and when armature 100 is in the second position, it is in another stable state. Armature 100 is in the first position when it is adjacent to central portion 46 and winding 70. Armature 100 is in second position when it is adjacent to central portion 28 and winding 68. In order to move between the first position and the second position, the armature 100 must pass through the center of space 80. Armature 100 enters an unstable state as it passes through the center of space 80.

Figure 6:
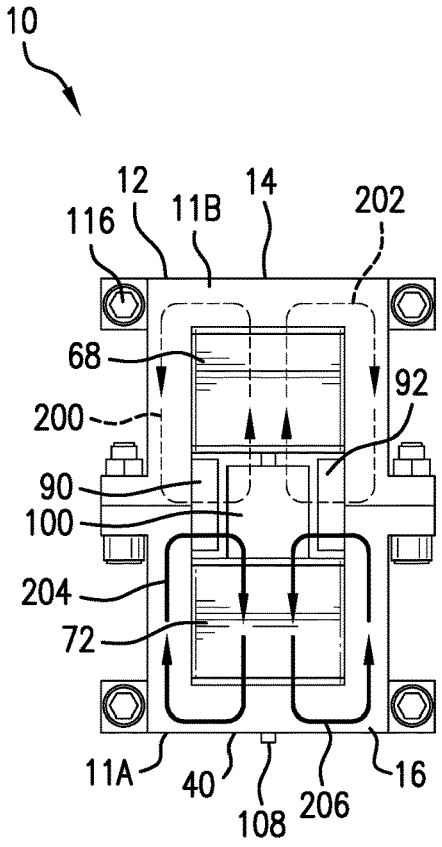
FIG. 6 is a diagram showing the permanent magnetic flux density in one section of the bi-stable pin actuator and the permanent magnet flux density in another section of the bi-stable pin actuator, the permanent magnet density in one section of the bi-stable pin actuator holding an armature of the bi-stable pin actuator in one stable state.

FIG. 6 shows armature 100 in an initial first position and in a first stable state. Armature 100 is adjacent to central portion 46 and winding 72 and pin 104 protrudes from opening 58 in portion 40 of core 12. At this time, windings 68 and 72 are not energized, therefore all flux is generated by permanent magnets 90 and 92. Substantially all of the permanent magnetic flux density, indicated by arrows 204 and 206, is in section 11A of actuator 10 due to the lower reluctance of these flux paths. As result, this strong permanent magnet flux density holds armature 100 in this initial first position. The permanent magnetic flux in section 11B of actuator 10 is indicated by arrows 200 and 202 is the relative weak and does not have the strength to pull armature 100 through the unstable center of space 80 and over to the second position that is adjacent to central portion 28 and winding 68.

Figure 7:
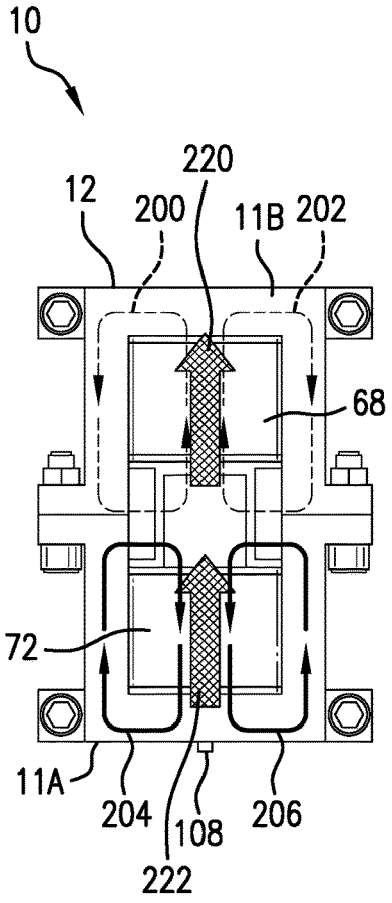
FIG. 7 is a diagram illustrating energization of windings in the bi-stable pin actuator in order to generate a magnetic flux that opposes the permanent magnet flux holding the armature in the current stable state and supplements the permanent magnet flux in another section of the bi-stable pin actuator to magnetically pull the armature into the other stable state.
Figure 8:
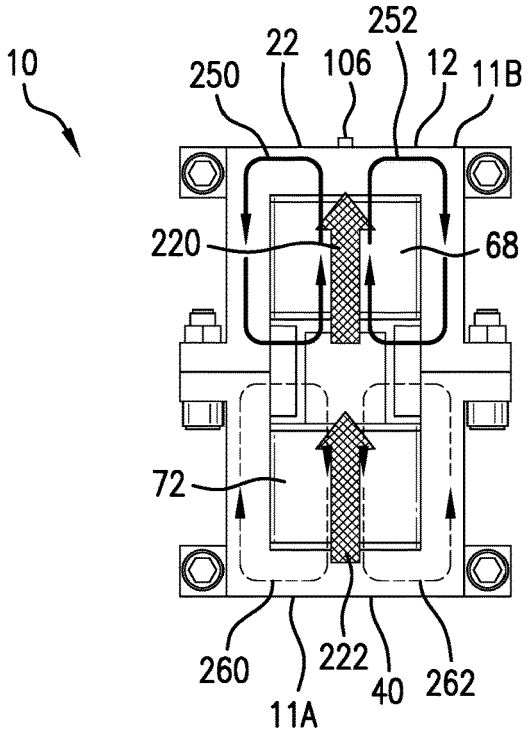
FIG. 8 is a diagram illustrating the total flux in a section of the bi-stable pin actuator resulting from supplementing the permanent magnet flux in that section of the bi-stable pin actuator with the magnetic flux from the energized windings, wherein the total flux has a sufficient magnetic flux density to magnetically pull the armature into another stable state.
Figure 9:
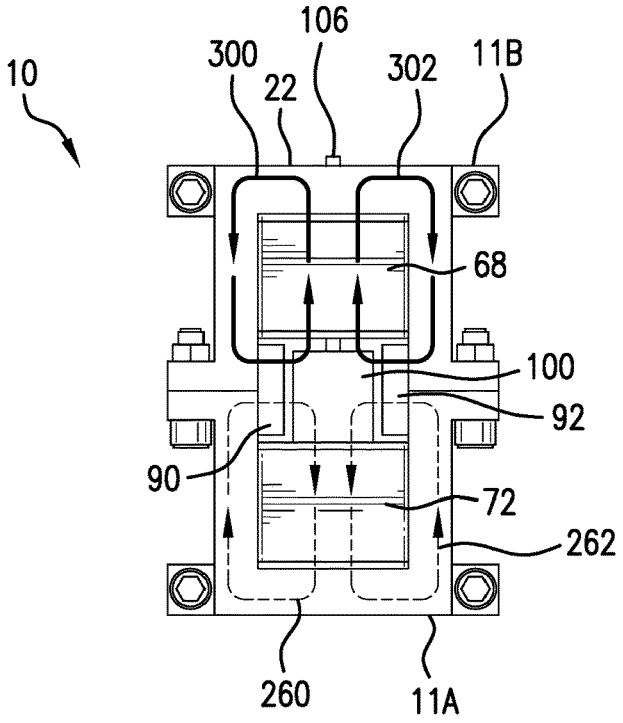
FIG. 9 is a diagram illustrating the permanent magnet flux density throughout the bi-stable pin actuator after the armature has been magnetically pulled into the other stable state.

Referring to FIG. 7, when it is desired to shift armature 100 from the first position into the second position and thus to the second stable state, electrical current is applied to winding 68 and/or winding 72 in order to energize the winding. Arrows 220 and 222 indicate the flux generated by energizing either or both windings 68 and 72. Flux 220 and 222 opposes the permanent magnet flux 204 and 206 that holds armature 100 in the first position and supplements permanent magnet flux 200 and 202 so as to steer flux into section 11B of actuator 10 in order to pull armature 100 away from the first position. Referring to FIG. 8, as a result in the decrease in the magnetic flux density in section 11A and an increase in magnetic flux density in section 11B, the permanent magnetic flux previously holding armature 100 in the first position is significantly reduced and is now indicated by reference numbers 260 and 262. As a result, the total magnetic flux density 250 and 252 in section 11B has sufficient strength to pull armature 100 through the unstable state and into the second position and thus, the second stable state. As a result, pin 104 is withdrawn from opening 58 in widthwise end 40 and now protrudes through opening 39 in widthwise end 22. In FIG. 9, the energization of windings 68 and 72 has ceased and magnetic flux 300 and 302 in section 11B is permanent magnet flux and is sufficient to hold armature 100 in the second position and thus, the second stable state. The permanent magnet flux 260 and 262 in section 11A is too weak to pull armature 100 back to the first position.

It is to be understood that is sufficient electrical current is used, only one of the windings 68 and 72 need be energized to generate a flux that supplements the permanent magnet flux in one section of actuator 10 while simultaneously opposing the flux in an another section of actuator 10. Otherwise, a lower electrical current could be applied to both windings 68 and 72 to supplement the permanent magnet flux in one section of actuator 10 and oppose the permanent magnet flux in another section of the actuator.

If it is desired to move armature 100 back to the first position, then one or more windings 68 and 72 are energized to oppose the permanent magnet flux in section 11B and supplement the permanent magnet flux in section 11A. Armature 100 is then pulled from the second position back through the unstable state and into the first position wherein the armature is adjacent to central portion 46 and winding 72

(see FIG. 6). As a result of the movement of armature 100, pin 104 is withdrawn from opening 39 and now once again protrudes through opening 58.

Bi-stable pin actuator 10 provides many advantages and benefits. Pin actuator 10 is bi-directional due to its symmetric structure and therefore can be fired and reset by actuating in opposite directions. Pin actuator 10 can be fired repeatedly. With respect to the movement of armature 100 and pin 104, pin actuator 10 provides a short stroke with high force. The short strike occurs within $1/10^{th}$ second from the command. Power is only applied during actuation thereby conserving energy. Therefore, armature 100 is held in either stable state without the application of electrical current to the windings 68 and 72. A relatively small amount of energy is needed to actuate pin actuator 10. Specifically, a battery is sufficient to provide the electrical current to the windings 68 and 72. Actuator 10 dissipates negligible heat and does not release any contaminants when activated. Actuator 10 is relatively small in size making it suitable for applications where there is limited space.

Prototype testing has confirmed many of the aforesaid advantages and superior operating characteristics. For example, when windings 68 and 72 are not energized, the permanent magnet flux can hold armature 100 in either the first position or second position with up to twenty-four (24) pounds-force applied to armature 100. The actuation time is less than 100 milliseconds. A prototype fit within a 1.5"× 2.0"×0.7" rectangular volume.

Although the foregoing description is in terms of the deployable multi-section boom being used with spacecraft, it is to be understood that the multi-section boom may be used with other devices including, but not limited to, vehicles, robots including robotic devices used by law-enforcement or military bomb-disposal units and fail-safe laboratory equipment, etc.

The preceding description of the disclosed embodiments is provided to enable any person skilled in the art to make or use the present invention. The embodiments were chosen and described in order to best explain the principles of the invention and its practical applications. Various modifications to these embodiments will readily be apparent to those skilled in the art, and the generic principles defined herein may be applied to other embodiments without departing from the spirit or the scope of the invention. Thus, the present invention is not intended to be limited to the embodiments shown herein but is to be accorded the widest scope consistent with the following claims and the principles and novel features disclosed herein. Any reference to claim elements in the singular, for example, using the articles "a", "an" or "the" is not to be construed as limiting the element to the singular.

What is claimed is:

1. A bi-stable pin actuator comprising:

a core made from soft magnetic material and including a first central portion and a second central portion that is separated from the first central portion by a space, the first central portion having a first passage extending there-through and the second portion having a second passage extending there-through;

a first conductive coil wound about the first central portion of the core and configured to be energized with an electrical current;

a second conductive coil wound about the second central portion of the core and configured to be energized with an electrical current;

a first permanent magnet located within the space between the first central portion and second central portion and attached to the core;

a second permanent magnet located within the space between the first central portion and second central portion and attached to the core, the second permanent magnet being positioned across from the first permanent magnet;

wherein the first and second permanent magnets each have horizontally oriented North (N) and South (N) poles and like poles of the first and second permanent magnets face each other;

an armature made of soft magnetic material and movably positioned within the space between the first central portion and the second central portion, the armature being positioned between and spaced apart from the first permanent magnet and the second permanent magnet, the armature being movable between a first position wherein the armature is adjacent to the first central portion of the core and the first conductive winding and a second position wherein the armature is adjacent to the second central portion of the core and the second conductive winding, wherein the armature is in one stable state when in the first position and in another stable state when in the second position, the first permanent magnet and the second permanent magnet generating magnetic flux having a magnetic flux density sufficient to hold the armature in either the first stable state or the second stable state when neither coil is energized;

a pin member having a first end and an opposite second end and being attached to the armature, the pin extending into the first passage of the first central portion of the core and into the second passage of the second central portion of the core so that movement of the armature causes the pin to longitudinally move within the first passage and the second passage, wherein only the first end of the pin member protrudes from the core when the armature is in one stable state and only the opposite second end of the pin member protrudes from the core when the armature is in another stable state; and wherein energizing at least one of the conductive coils generates in a first section of the bi-stable pin actuator a magnetic flux that opposes the magnetic flux holding the armature in a current stable state and supplements the magnetic flux in a second section of the bi-stable pin actuator so as to shift the armature into another stable state.

2. The bi-stable pin actuator according to claim 1 wherein the core comprises a first core section and a second core section attached to the first core section.

3. The bi-stable pin actuator according to claim 1 wherein the first core section and second core section are bolted together.

4. The bi-stable pin actuator according to claim 1 wherein the second passage is coaxial with the first passage.

5. The bi-stable pin actuator according to claim 4 wherein the armature includes a third passage that is coaxial with the first passage and the second passage, the pin being disposed in the third passage and attached to the armature.

6. The bi-stable pin actuator according to claim 2 wherein the first core section and second core section are identically constructed.

7. The bi-stable pin actuator according to claim 6 wherein the first core section includes the first central portion and further comprises:

a widthwise end portion;

a first generally "L" shaped leg portion that extends from the widthwise end portion;

a second generally "L" shaped leg portion that extends from the widthwise end portion; and wherein the first central portion extends from the widthwise end portion and is located between and spaced apart from the first generally "L" shaped leg portion and the second generally "L" shaped leg portion, the first central portion extending to an end.

8. The bi-stable pin actuator according to claim 6 wherein the second core section includes the second central portion and further comprises:

a widthwise end portion;

a first generally "L" shaped leg portion that extends from the widthwise end portion;

a second generally "L" shaped leg portion that extends from the widthwise end portion; and wherein the second central portion extends from the widthwise end portion and is located between and spaced apart from the first generally "L" shaped leg portion and the second generally "L" shaped leg portion, the second central portion extending to an end.

9. The bi-stable pin actuator according to claim 1 further including a first spool mounted on the first central portion, wherein the first conductive coil is wound about the first spool.

10. The bi-stable pin actuator according to claim 9 further including a second spool mounted on the second central portion, wherein the second conductive coil is wound about the second spool.

11. The bi-stable pin actuator according to claim 10 wherein the first spool and second spool are made from fiberglass.

12. The bi-stable pin actuator according to claim 1 wherein the first permanent magnet and the second permanent magnet are rare-earth magnets.

13. The bi-stable pin actuator according to claim 1 wherein the first permanent magnet and the second permanent magnet are bonded to the core.

14. The bi-stable pin actuator according to claim 1 wherein the core includes a plurality of thru-holes for receiving fastener devices for attaching the bi-stable pin actuator to a structure or apparatus.

* * * * *